US006030332A

United States Patent [19]

Hensley

[11] Patent Number: 6,030,332

[45] Date of Patent: Feb. 29, 2000

[54] CENTRIFUGE SYSTEM WITH STACKED DISCS ATTACHED TO THE HOUSING

[76] Inventor: Gary L. Hensley, P.O. Box 2965, Houston, Tex. 77252

[21] Appl. No.: 09/060,045

[22] Filed: Apr. 14, 1998

[51] Int. Cl.[7] ..... B04B 1/20

[52] U.S. Cl. ..... 494/53

[58] Field of Search ..... 494/50–56, 60, 494/68–73; 210/380.1, 380.3

[56] References Cited

U.S. PATENT DOCUMENTS

| | | | |
|---|---|---|---|
| 2,622,794 | 12/1952 | Smith | 494/53 |
| 2,625,320 | 1/1953 | Lyons | 494/54 |
| 2,670,131 | 2/1954 | Ried | 494/51 |
| 2,711,854 | 6/1955 | Kjellgren | 494/51 |
| 2,743,864 | 5/1956 | Lyons | 494/54 |
| 4,009,823 | 3/1977 | Nozdrovsky | 494/53 |
| 4,042,172 | 8/1977 | Nozdrovsky | 494/53 |
| 4,209,128 | 6/1980 | Lyons | 494/53 |
| 5,182,020 | 1/1993 | Grimwood | 210/512.1 |
| 5,306,225 | 4/1994 | Miyano et al. | 494/53 |
| 5,310,399 | 5/1994 | Suzuki | 494/53 |
| 5,314,399 | 5/1994 | Suzuki | 210/380.3 |
| 5,364,335 | 11/1994 | Franzen et al. | 494/53 |

FOREIGN PATENT DOCUMENTS

| | | | |
|---|---|---|---|
| 732040 | 4/1966 | Canada | 494/51 |
| 788845 | 7/1968 | Canada | 494/53 |
| 1449064 | 7/1966 | France | 494/51 |
| 2662372 | 11/1991 | France | 494/53 |
| 906798 | 3/1954 | Germany | 494/51 |
| 1482719 | 1/1970 | Germany | 494/53 |
| 2-40248 | 2/1990 | Japan | 494/53 |
| 308777 | 7/1971 | U.S.S.R. | 494/51 |
| 425656 | 4/1974 | U.S.S.R. | 494/53 |
| 553001 | 4/1977 | U.S.S.R. | 494/53 |
| 899310 | 6/1962 | United Kingdom | 494/51 |

*Primary Examiner*—Charles E. Cooley
*Attorney, Agent, or Firm*—Gunn & Associates, P.C.

[57] ABSTRACT

A centrifuge having a riotatable housing with a tapered portion and with a straight portion. On the interior, a flited conveyor is installed. The conveyor is scrolled at a speed causing the flites to move heavier particles along the conveyor from the straight portion and to the end of the tapered portion, thereby raising the heavier components out of the pond of liquid accumulated in the rotating housing. On the interior of the flited conveyor, there is a stack of closely spaced discs which are rotated with the housing The discs define a enlarged surface area for the pond so that separation of heavier weight materials in the pond is enhanced. The heavier particles pass through the discs and into the flited conveyor for scrolling. The stack of discs enhances the effective pond surface area.

44 Claims, 3 Drawing Sheets

51'
50
50
48''
48'
51
13'
48
41
48''
48''
13
48
51

CENTRIFUGE SYSTEM WITH STACKED DISCS ATTACHED TO THE HOUSING

BACKGROUND OF THE DISCLOSURE

This disclosure is directed to a high volume centrifuge system capable of processing great quantities of liquid and removing suspended solids from the liquid. It finds application in food processing industries. It is also useful in waste separation, for example, the waste sludge of a food processing plant. It is also very useful in separating emulsifications into separate phases, i.e., droplets of oil or suspended solids in solution. It also is effective in separating dissolved earth products such as sand, clay, silt, and other particles from water or other liquids. One particular use of significance is the separation of solids formed into an emulsification in drilling fluids that carry drill bit cuttings.

Consider an example of the application of this device. In a drilling rig, the drill bit lubricant is often made of water with suspended clay products in it. This serves as the lubrication system for the drill bit. At the surface, water is mixed with various clay products to form what is known as drilling mud which is pumped down the well borehole through the drill stem, then flows out of the drill bit at the lower end, and is returned to the surface in the annular space on the exterior. It washes away cuttings of the formation. As the cuttings are removed from the vicinity of the drill bit, the well is advanced, the drill bit is cooled and lubricated, and the drilling process continues with recycling of the drilling mud. The drilling mud, however, picks up broken pieces of sand or shale from the formations being penetrated, carries them to the surface where the particles are classified ideally removing the bits and pieces ol the formation so that the drilling mud can be recycled. Recycling involves removing at least some or most of the formation materials from the return mud stream so that it can then be pumped again through the mud pump along the drill stem and back to the drill bit, thereby repeating this cycle. It is not uncommon for the flow rates to be several hundred gallons per minute. Volumes as large as 400 gallons per minute are pumped into the well borehole and returned. With a flow velocity that great, the velocity of the drilling mud in the return annular space is sufficiently fast that the drill bit cuttings are lifted and returned to the surface.

High volume separation is important in the foregoing context. There are devices that are sold for that purpose today. However, they often are limited. There are contradictory design requirements which come into play. These design requirements are manifest in the tradeoffs involved in designing such a high volume device. Consider as an example a high volume centrifuge which has a capacity of about 60 gallons per minute. One such device is the Sharples Model P-95000. This commercially available centrifuge has a pool of about 1,670 sq. inches. The device of the present disclosure can be readily made (in a comparable model) having a pool of about 18,000 sq. inches, or more than about ten times larger. The dwell time of the solids is markedly reduced because the present device has a pool which is about 0.40 inches deep on the average while the above mentioned device has a pool of about 1.8 inches. This represents a reduction of about 75%. By contrast, this device is less than about one-half the length. As length is reduced, the weight of the rotor is reduced. This device is provided with a rotor of 30 inches diameter in comparison with 40 inches; by making these changes, this rotor can have a rotating speed of about 3,000 rpm compared to 2,000 rpm for the referenced device. This reduces the weight of the roller from about 9,000 pounds to about 3,000 pounds. By reducing the weight and shortening the length of the shaft, and yet rotating at a higher velocity, the maximum gravity force is changed from about 2,100 G to the vicinity of 2,800 G at the bottom of the pool and changed from 1620 G to about 3,300 G at the top of the pool in the device of this disclosure. This marked increase in gravity pull with the enlarged pool area results in the representative device of this disclosure having a throughput of something over 400 gallons per minute which is many times greater than the rated throughput of about 60 gallons per minute of the competitive device. The life of the equipment is markedly enhanced. Consider, for instance, the service life of the bearings which are probably the most crucial limit on life. Bearing life is related to the race velocity. If for instance a bearing assembly has the diameter increased by 50%, the race velocity goes up by 50%. Race velocity itself however is limited depending on the design of the race and the bearings in the race.

Therefore the race velocity significantly serves as a limit. As the rotated weight goes up, the size of the bearing assembly must increase to provide a larger number of rotor elements in contact with the raceway to support the greater amount of weight. To be sure, the diameter of the bearing assembly can be reduced by simply doubling up on the number of bearing assemblies. This however is costly in that it makes the equipment longer and requires more bearing assemblies. The optimum way to reduce the cost of the bearing and to increase their life is to reduce the rotated weight which is accomplished in this device. A reduction by two-thirds is significant in extending bearing life.

One advantage of the present apparatus is the incorporation of a disc stack. The disc stack is held in place with a key member aligning the discs. This defines an enhanced surface area. Restated, the disc stack has the advantage of increasing the surface area of the pool. The pool therefore becomes much more expansive. Between adjacent discs, the liquid and sediment suspended in it respond to the increase in gravity. So to speak, a differential between the sediment particles and the liquid of perhaps 1.03 becomes markedly enhanced when exposed to the high gravity forces occurring in the rotating disc. This carries the water to the interior and spins the heavier particles to the exterior. This enables the dry material to be separated more readily and thereby enhances the volumetric throughput.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
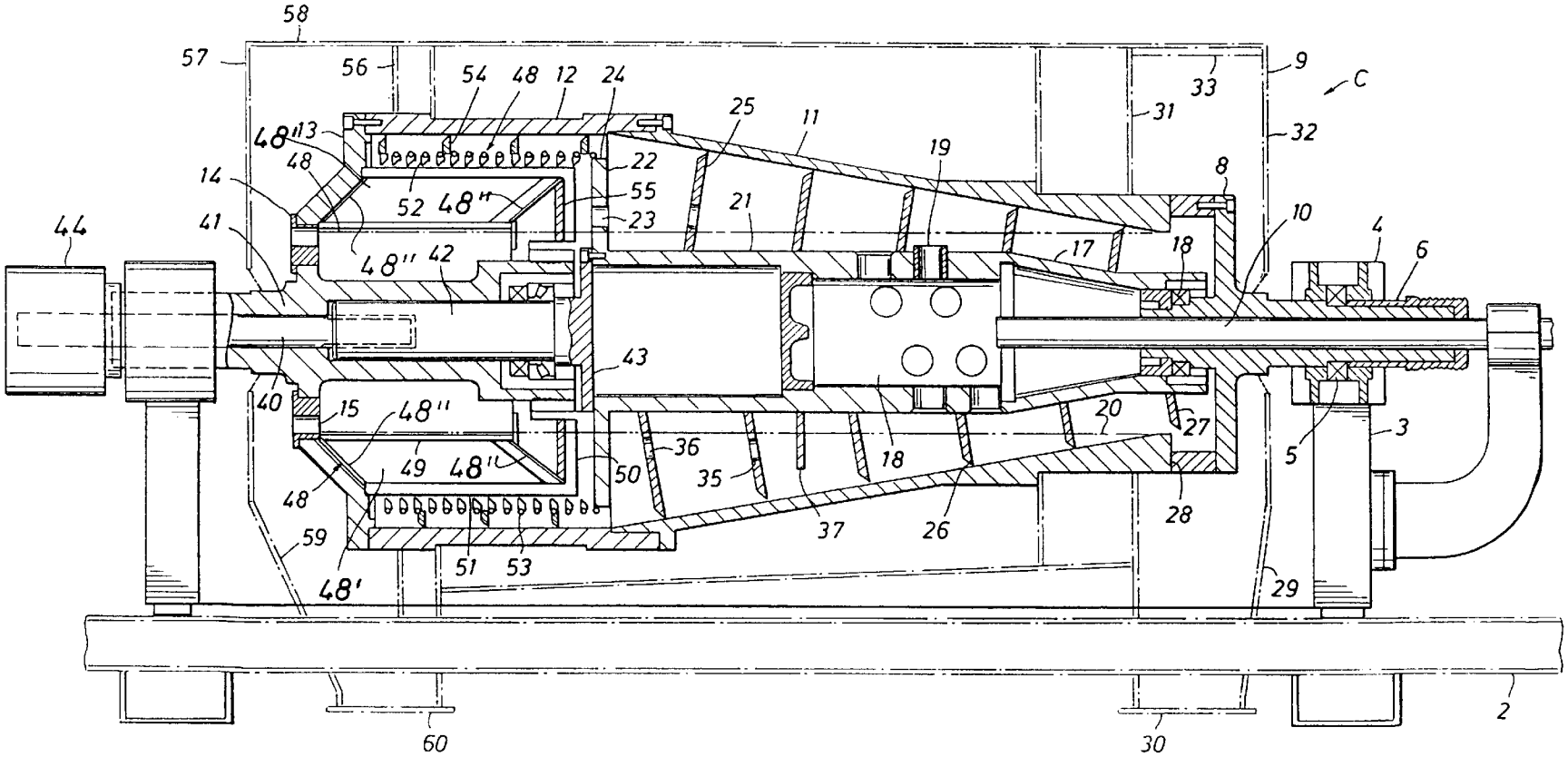
FIG. 1 is a sectional view through the centrifuge of the present disclosure illustrating internal details of construction wherein this view is a sectional cut through the structure coincident with the centerline axis thereof.

Attention is directed to FIG. 1 where the centrifuge of the present is identified by the letter C. The centrifuge C will be described proceeding from the right hand end. That is the input end. The description will proceed from right to left and will discuss the input of rotational power. In addition, the flow of liquid from a feed line is discussed.

The numeral 2 identifies a stationary frame which supports the equipment on an upstanding post 3. The post terminates in a pillow block housing 4. That housing supports a bearing assembly 5 which enables a hollow rotating shaft 6 to extend through the pillow block housing. The shaft 6 is rotated. It is connected with a motor drive mechanism which either through belt drives or direct connection rotates the hollow shaft 6 in a specified direction. The preferred operating speed for this unit is 3,000 rpm. For the scale of the device to be discussed, this requires a motor of about 150 hp rating intended for continuous operation. Through appropriate drive belts (not shown) power is delivered to the drive shaft 6. It is rotated as mentioned. The drive shaft 6 connects with a laterally protruding hub 8. The hub is located on the interior of a removable cover or shell 9 which is a protective cabinet to prevent contact with rotating equipment from the exterior. The shell 9 is somewhat similar to an elongate drum which is split along one side to open and the opposite side is provided with a hinge. The shell 9 splits approximately into two halves. The bottom half is mounted on the frame 2 and the top half swings open thereabove. It is a safety device.

A feed tube 10 extends axially through the drive shaft 6. The shaft 6 is hollow and is sized to fit around the feed tube. The feed tube 10 is connected to a flow line capable of delivering several hundred gallons per minute, the preferred rating being about 400 to 450 gallons per minute. A suitable connector (not shown) is affixed to the end of the feed tube 10 to deliver the flowing liquid carrying the sediment to be separated by the present device.

The hub 8 is rotated with the drive shaft 6. Rotation of the hub imparts rotation to a conic housing 11. The conic shaped housing 11 bolts to the hub 8. On the interior, the hub and housing support a conveyor system to be described. The housing 11 tapers outwardly to define a larger cross section moving toward the center of the equipment. The tapered housing 11 connects with a cylindrical housing unit 12. The two components are joined at a suitable flange with appropriate threaded fasteners. The housing 12 is for all practical purposes cylindrical on the interior. It defines an interior face or surface which is smooth to engage certain conveyor flites which scroll the separated solid ingredients toward the dry end for disposal as will be explained. The elongate cylindrical housing 12 extends to the left where it terminates at a transverse hub 13 which is bolted to it, again using similar fasteners and accomplishing a connection on a circle matching the opposing flange around the hub 13. The hub 13 extends inwardly to an adjustable dam plate 14 which is perforated with an opening 15 (one of several) to be described. The openings 15 together is a controllable outlet. The volumetric throughput through the dam openings 15 will be discussed in detail.

The components 8, 9, 11, 12, 13 and 14 together rotate as a unit. They are the outside of the centrifuge. The cover 9 does not rotate; it is included as a safety cabinet. From the right hand end where the hub is first introduced, the housing rotates. The speed of the housing is 3,000 rpm in the preferred embodiment. That is determined by the speed of the drive motor imparting rotation to the shaft 6.

Going back to the right hand side of the sectional view of FIG 1, the fixed feed tube 10 is centrally positioned in a bearing assembly 16 supported on the hub 8. The open end of the fixed feed tube terminates on the interior of a rotating conic transition piece. The feed tube 10 is the high point for liquid which flows down to the outlet openings 15. This flow path removes liquid at the rate the tube 10 delivers it into the centrifuge. The transition piece 17 is a conic shell around the feed tube which tapers from right to left, becoming larger in diameter. The feed tube delivers liquid into a cylindrical chamber 18. The chamber 18 is emptied by a plurality of feed nozzles opening radially outwardly. The nozzles 19 are numerous, the preferred number being 12 which are spaced lengthwise and circumferentially. This is a chamber which is rotated so that liquid introduced from the feed tube is thrown toward the wall of the chamber 18 and flows outwardly through the nozzles 19. At this juncture, it must be noted that the introduced liquid moves radially outwardly in the chamber 18. It does not "fall down" as one would normally think on viewing the structure in a static condition. When the equipment is on, the liquid is compelled radially outwardly. It passes through the several nozzles 19 and accumulates to the pond or liquid level 20. The liquid level 20 is achieved after introducing a flow into the spinning equipment. This liquid level is centrifically forced radially outwardly so that the top of the liquid level is at 20. So to speak, that defines the maximum liquid height. The significance of this will be explained as the separation of dry particles from the liquid mass is explained. Suffice it to say, the flow from the chamber 18 is through the nozzles 19 to accumulate in the pond 20. Through the remainder of this disclosure, the term pond will be applied to the liquid achieving the maximum level at 20. The pond 20 has a length defined by the equipment and a width equal to the circumference of the pond. The top of the pond is a cylindrical surface while the bottom of the pond is contoured to the housing that surrounds the pond.

The chamber 18 is not filled with liquid in the normal sense.

Liquid is poured into it. A vortex may form at the center as the liquid is forced to move to the exterior. This adds liquid to the pond 20 to replace that which is removed as a result of the separation. The chamber 18 is formed on the interior of an elongate cylindrical shell 21. The shell 21 ends at a transverse flange 22 which has a peripheral outer face 24 representing a step in diameter. There is an opening 23 which is arranged just below the surface of the pond 20. This enables liquid to flow from the right to the left. To be sure, liquid flows beyond the face 24, i.e., near the bottom of the pond. There will however be some stratification in that flow, namely, there will be a migration of the separated solids moving from left to right while there is a current of liquid from right to left as will be detailed. The shell 21 is an elongate cylindrical structure having a smooth exterior except at the locations where the nozzles are mounted. In addition, the shell supports the flites 25 of a conveyor. The flites 25 represent a single helix conveyor system. It extends from the transverse flange 22. The flites have a lead or pitch angle. They are reduced in diameter to fit within the conic shell 11. The flites 25 are carefully trimmed at the outer edge 26 so that they do not scrape or bind against the surrounding conic housing. The flites however do provide a minimal clearance so that scrolling of solid particles from left to right occurs. The particles are moved by the carefully constructed sharp edge 26 to the last flite 27 defining a gap over a downwardly directed opening 28 which is at the top end of a solid funnel 29 which dumps the solids out of the rotating equipment through the stationary cabinetry and out through a discharge port 30 for the solids. The port 30 is stationary and points downwardly. The discharge opening 28 rotates and therefore must be located under the cover and between the inside wall 31 and the end wall 32. These two walls funnel the particles around the unmoving cabinet. If need be, some kind of impact liner 33 is installed in this area. The particles may impact but they are nevertheless directed downwardly. They fall out through the opening 30.

Newly introduced but unclarified liquid flows through the nozzles 19 into the pond 20 in that region. The liquid flows to the left. To this end, the liquid moves to the left through the flites at the openings 35 and 36 which are arranged in the flites near the top of the pond 20. This enables some measure of separation in the flow path namely the lighter liquid can flow through the openings 35 and 36 and stay near the top of the pond. By contrast, solids in the liquid are forced to a larger radial location by a weir disc 37. The weir 37 cooperates with the openings 35 and 36 to define a bend in the flow path, thereby delivering the freshly introduced and heavily laden liquid toward the outer radius, i.e., to a location where the G forces acting on the solids are even greater. When the radius is increased, the forces on the particles increases with radius.

The flange 22 is at the end of the internal, cylindrically shaped shell 21 which supports the flites of the conveyor. A flow path for liquid from right to left exists using the ports or nozzles 19 into the pond 20, the liquid then flowing toward the bottom and under the weir 37 and near the top of the pond through the openings 35, 36 and 23. This introduces the liquid into the disc stack container. That is located on the interior of the right cylinder shell 12. Describing that equipment from the centerline radially outwardly, the central components include a rotatable shaft 40 concentric and on the interior of a rotatable sleeve 41. The shaft 40 is connected by a suitable spline connection to an enclosed shaft 42 which terminates at a connective flange 43 which is smaller in diameter than the flange 22 but which bolts to it to thereby define structural support holding the equipment together and also imparting rotation to the shell 21. A gear box 44 is connected between the central shaft 40 and the surrounding sleeve 41. The gear box 44 transfers powers at a different speed to the components on the interior.

In very general terms, there are three substantial rotating components in the system. For simplistic representation, the three rotating components are the external housing, the flited conveyor, and the mass of the liquid. The relative velocities between them are important to initiate an appropriate scrolling action. First, some representative values will be given and the scrolling action will then be discussed in that context. The representative speeds are merely that; obviously the equipment can run at different speeds for different products.

A substantial high speed electric motor with appropriate gearing is connected to the outer shell or housing which is ideally rotated at 3,000 rpm. This includes the external components including the drive shaft 6, the connected flange 8. the housing 12 and the tapered transition housing 11 which connects to it. This also includes any component of the housing which is connected on the outside of the conveyor flites as will be described. All of that equipment rotates at 3,000 rpm. Moreover, the shaft 41 transmits that rotation to the gear box 44. The gear box 44 rotates in response to the rotation of the housing. It includes a gear system which transfers rotation to the shaft 40 on the interior. That in turn rotates the conveyor flites in the same direction but at a different speed. The flites in this system are arranged so that the conveyor runs at a slower speed to achieve scrolling of solids from the left to the right. The differential of this speed relates to the effectiveness of the equipment. The gear box 44 therefore provides a speed which is set at a selected value slightly slower than the speed of the housing. The conveyor speed is adjusted to a speed of up to about 3% less than the housing speed. For instance, at 2% less, this requires the conveyor to operate at a speed of 2,940; the difference between 2,940 and 3,000 rpm represents the scrolling speed or about 60 rpm. With a ratio of that sort, the scrolling action performed in the system is able to move the solids up to the outlet end at the right. They are eventually removed as dry particles.

It was noted that there are three rotating masses, where one is the external housing. The second is the conveyor on the interior which initiates the scrolling action just mentioned. The third rotating mass is the weight of liquid. The pond 20 is quieted, i.e., it is stilled. Turbulence in the pond is quieted so that the solids suspended in the liquid can respond to move through enhanced forces. Rather than responding to the force of gravity, they respond to forces as large as 3,300 G or greater. If a solid particle has a specific gravity of 1.005, it will take a substantial interval for it to settle to the bottom of the stilled pond without the enhancement of greater gravity forces acting on the particle. One advantage of the present disclosure is that the pond is made more shallow. A hypothetical particle at the top of the pond 20 does not have very far to travel, the optimum distance being less than 0.4 inches, the maximum distance in this pond construction. It would take a great many hours for the hypothetical particle of the specific gravity just mentioned to settle to the bottom. The speed of settling is markedly changed by reducing the depth of the pond; it is also remarkably changed by increasing the G forces acting on the particle. Rather than a mere 2,000 G forces, this equipment provides forces in excess of 3,000 G or more. That makes a tremendous difference in the speed of settling. Recall that the rotating mass of liquid is stilled; the hypothetical fresh droplet of introduced liquid transferred to the left is then received in the housing which encloses a disc stack 48. The disc stack 48 should now be considered. It tremendously increases the effective pond surface area.

Figures 2A, 2B:
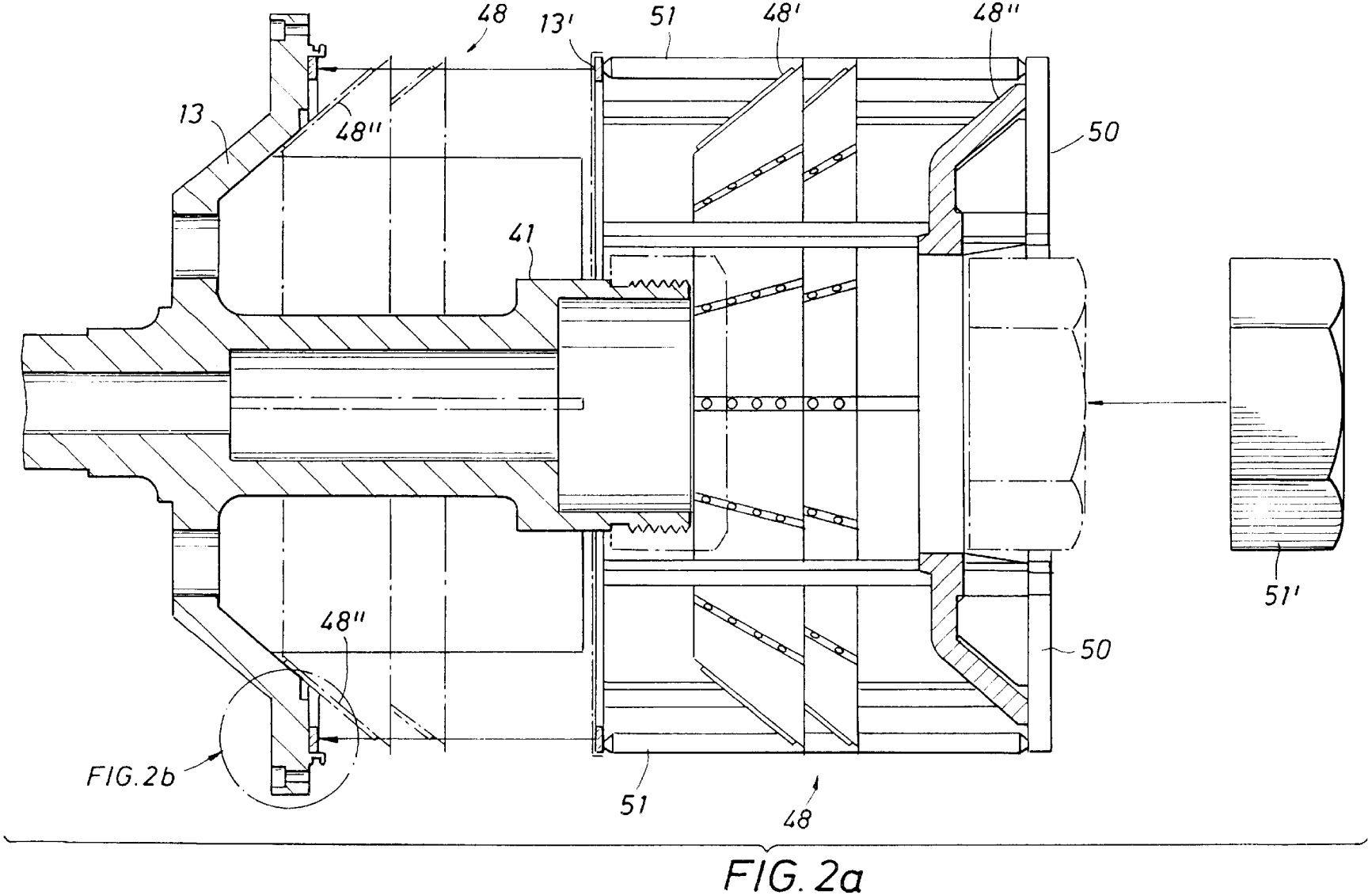
FIG. 2*a* is an exploded sectional view of the disk stack assembly.
FIG. 2*b* is an enlarged sectional drawing showing the cooperation of end disc plates in the disc stack assembly.
Figure 2B:
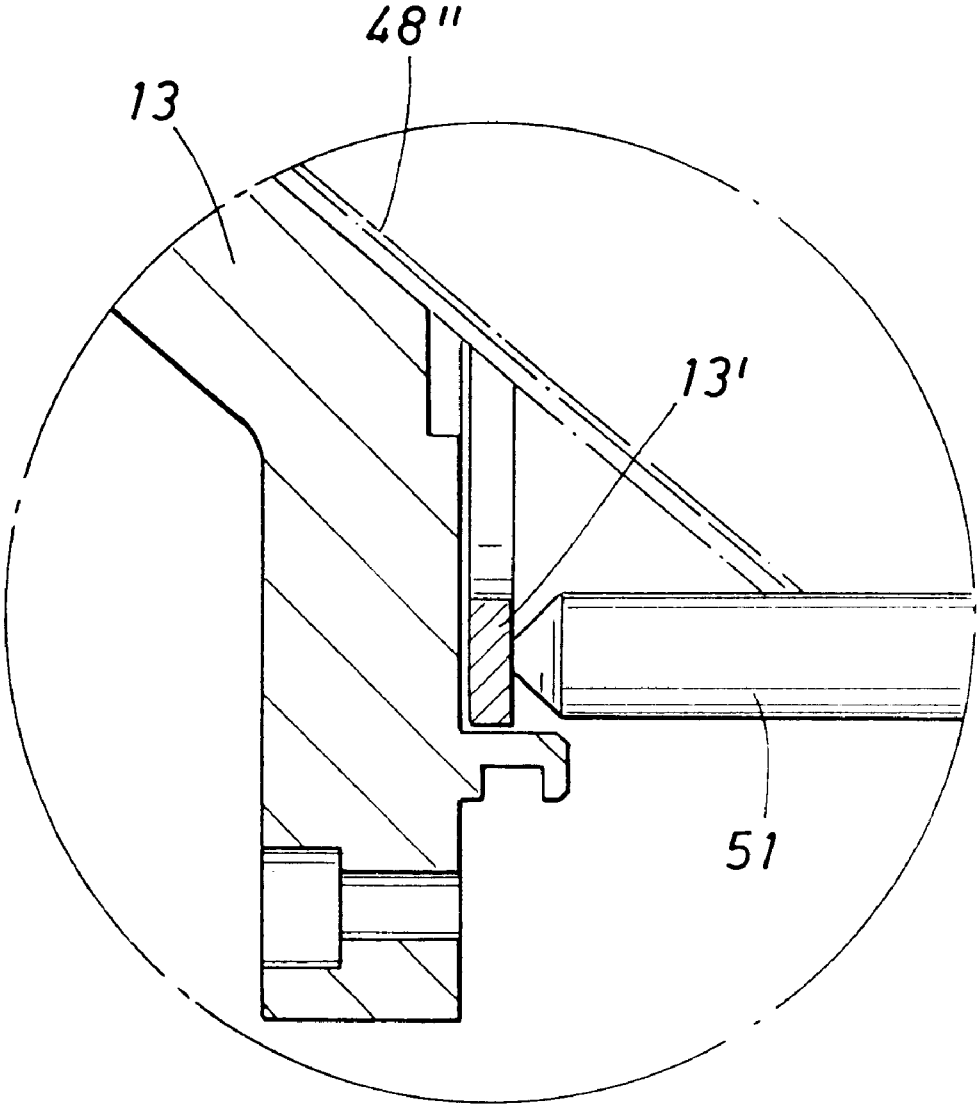

The disc stack 48 comprises a stack of discs vanes 48' and disc plates 48" at adjacent canted angles spaced side by side, and they are part of the housing. Representative vanes 48' and disc plates 48" are shown in FIG. 1. The stack of discs therefore rotates at the housing speed or 3,000 rpm in this example. It is surrounded by a set of flites on a cage which is an open lattice work. This enables solids to migrate radially outwardly while the liquid rises to the top of the pond 20. To this end, the multiple discs which make up the disc stack 48 are all alike and differ only in spacing. They are positioned side by side by side, etc. and are therefore deployed to enhance the separation. They have the effect of increasing the pond surface area. The surface area increase is related to the liquid contact area of each disc. Since the discs are substantially identical differing only in position, the surface area accomplished by one disc is simply multiplied by the total number of discs in the stack to obtain the total surface area. Moreover, this stack of discs is an assembly which is anchored to the housing which rotates at the housing speed. Recall the earlier description of the components 11, 12, 13 and 14, they define the outside housing of the structure. The several discs are mounted on the exterior of the hollow shaft which supports the dam 14 with the holes 15 having the opening for delivery of liquid. Considering first the discs, they are locked on an elongate keyed hub 49. The discs are confined by a radially extending accelerator vane 50. The vane 50 extends radially outwardly to a lengthwise rib 51. With four, six, and up to about 12 vanes 50 and each connected to a rib 51, the discs are collectively held together. The ribs 51 terminate at appropriate openings in the hub 13 and lock to it. FIG. 2*a* shows an exploded sectional drawing of the disk stack assembly 48 showing the rotatable sleeve 41 with some components omitted for clarity. This shows the arrangement of radially extending stacked vanes 48' and end disc plates 48" which comprise the disk stack assembly 48. Cooperation of the stack vanes 48' with the vanes 50 and lengthwise ribs 51 is shown. The radially extending vanes 50 are shown at the right hand end of the view and extends radially outwardly to connect with plural ribs 51 which collectively encircle the stack of discs 48. Each disc 48' is individually nested and they stack between the end most members 48". This stack of several discs 48' rotates as a unit. The full line position of the plural discs 48' against mounting ring 13' enables the entire stack of discs 48 and ribs 51 to move as a unit, all as indicated by the bracket in FIG. 2*a*, thereby permitting alignment and movement to the left in FIG. 2*a* to the dotted line location. All the discs are held in position by the compression nut 51'. At that position, the nut 51' locks the entire stack 48 against the hub 13. The ring 13' jams up against the hub 13 as shown at the left side of FIG. 2*a* and in more detail in FIG. 2*b*. This entire assembly in the bracket moves as a unit. The final position is achieved in FIG. 1 of the drawings. FIG. 2*b* is a cutaway showing the end disc plate 48" with respect to a rib 51, the hub 13 and the ring 13'.

Referring to both FIGS. 1, 2*a* and 2*b*, the position of the ribs 51 leaves a substantial gap around the periphery of the stack of discs. That gap comprises a substantial window enabling solids to flow radially outwardly from the stack. The ribs 51 just mentioned are straight and relatively few in number thereby leaving the bulk of the periphery open. The ribs are adjacent to a set of rings 52 forming a surrounding cage. The several rings are connected as an open face cage, there being two or three lengthwise rods connected from rib to rib so that the rings 52 together form a fixed cage. The elements in the ribs are circular; up to three rods hold the ribs together. This cage is around the disc stack 48 and concentric about the disc stack 48. The rings 52 collectively have an external face or surface defining a stiff, right cylindrical support cage. That cage serves as a guide for alignment of a flite equipped scrolling cage.

The cage is formed of three or four helical wires 53 wrapped with a lead angle. The wires 53 are joined to a set of flites 54 in a single helical conveyor. The flites 54 are a single helix supported on the small diameter wires 53 making up the helical turns. This defines and holds the shape of the helical flites 54 of the conveyor. At the right hand end, the wires 53 are welded to the outer face 24 of the hub 22. The flites 54 need the cage to maintain stiffness. Without the cage, the flites 54 would elongate or deflect, thereby stretching or warping from a specific length and diameter. Emphasis should be placed on the relative speed of the components around the disc stack 48. The disc stack 48, the accelerator vanes 50 and the ribs 51 all rotate with the housing, i.e., 3,000 rpm in the preferred embodiment. The multiple circular rings 52 do not have a helical angle; rather, they define a cage around the disc stack which is primarily open holes, i.e., there is very little interference with flow in the radial direction. This cage rotates with the helix 54 (formed as a single flite conveyor) and rotates at the conveyor speed, i.e., a different speed so that scrolling is effected. The helix speed is adjusted so that it scrolls solids at about a rate of one rps. It directs the movement of solid particles from left to right. The helical scroll is rotated at that speed because it is connected to the hub 22. Spot welds attach the several wires 53 and the flites 54 of the conveyor. This conveyor 54 does not taper in diameter; rather, it has a common or fixed radius along the length of it. The flites extend in helical fashion until they are even with the flange 22. The single continuous flite to the left of the fange 22 delivers heavier solid particles which are then forced up hill, so to speak, along the tapered face of the conic housing 11.

The flited conveyor 54 is subject to distortion with no stiffening from the cage on its interior. When torque is applied, it will twist with no restraint because the torque is applied at one end while the far helical end is free, i.e., it is unrestrained. Also, the helical coil is made of flexible steel susceptible of deforming if not confined in length and diameter.

Going back now to the disc stack 48 shown in FIGS. 1, 2*a* and 2*b*, liquid is introduced into this region without centrifugal agitation. In other words, there is no vortex in the pond at this region. The quieted liquid is then able to flow radially inwardly while the heavier particles flow radially outwardly between adjacent discs plate 48. Separation is achieved in this area. As a practical matter all of the liquid which is clarified and separated must flow through the disc stack before it is exhausted out of the system. While some measure of separation occurs to the right side between the flites 25, a good deal more separation and indeed the bulk of the cleaning occurs in the disc stack 48. Water or any viscous carrier flowing to the left is introduced into the disc stack. While it is spinning at the preferred speed, there is no relative motion for the small increments of the water just introduced because there is no vortex in that region. The water flows around the dam 55 and through the disc stack 48 to the top of the pond, now clarified, and is discharged through the openings 15.

There are several openings 15 which are located between radially directed stationary cabinet plates 56 and 57. There is a cylindrical portion of the cabinet 58 between these two plates which comprises an encircling liquid collection manifold. It funnels the flow downwardly through the tapered cabinet portion 59 and out through the liquid discharge opening 60. The discharge opening 60 is directed downwardly; the cabinet 58 intercepts discharged liquid which is thrown radially outwardly and which cascades down inside the fixed cabinet to the opening 60 and out of the equipment. This radial flow in the cabinet discharges the clarified liquid.

Particles cleaned out of the liquid are forced radially outwardly from the disc stack 48 and are then captured in the flites ol the conveyor, and are forced from left to right. They then arrive at the tapered or conic housing 11 and are forced along it also. They are ultimately delivered to the gap at the end of the conveyor, emerging next to the last turn 27 through the opening 28. The particles then fall out through the solid discharge opening 30 while the liquid is discharged from the liquid outlet 60. Both the openings 30 and 60 focus downwardly to discharge the segregated components by gravity.

The flow just mentioned is liquid at one port and particles at the other. The flow capacity of the system is enhanced by the disc stack 48. The feed is introduced into the conveyor region so that some separation occurs even in that area. It is however optimum that the last separation, hence the most difficult separation, occur with the liquid introduced substantially without vortex and in a quieted state to the disc stack 48. That is where the bulk of the separation occurs and especially the smaller particles of the slurry. This separation approach obtains the advantage of handling higher volumes. Ordinarily, the tendency would be to construct a larger device to handle a higher volume. That however is counterproductive for many reasons. This enhanced centrifuge C handles a larger volume because the bulk of the separation and indeed the most difficult aspect of it is accomplished in the quieted pond. That is to say, and observing only a single droplet introduced, it is in the disc stack 48 where it is not agitated, and is therefore more susceptible to separation. Furthermore, the disc stack has the effect of reducing the average depth of the pond. Not only does it increase the surface area but it also reduces the depth and thereby improves the throughput. Through this approach, the device can clean flow rates which are commonly encountered in deep well drilling. It can easily clean 400 gallons per minutes of drilling mud returned to the surface with downhole cuttings. By introducing the drilling mud into the system, large particles are immediately removed in the conic housing area but suspended particles in the mud are removed by the disc stack. It is able to remove particles of extremely small diameter. Those are the sort of particles which tend otherwise to stay in suspension. They are usually quite difficult to remove.

Drilling mud with cuttings returns to the surface for cleaning. With typical mud weight, depth of well, and common shale or sand formations, most of the mud supported solids are small; heavier cuttings may fall back to the bit and be ground by its continued rotation. In very general terms, the solids are classified in a range below about 0.1 inches and especially below about 0.2 inches in diameter. The mud flow is therefore centrifuged at a particle size below this dimension. In turn, the centrifuge is constructed with a disc spacing of about 0.2 inches at the maximum. This maximum distance or spacing defines the disc spacing; if wider, the disc stack is excessively long and the "settle" time becomes longer. The gap is limited to 0.2 inches so that drilling mud can be reclaimed and reused after removing most of the cuttings.

While the foregoing is directed to the preferred embodiment, the scope thereof is determined by the claims which follow.

What is claimed is:

1. A high speed centrifuge comprising:

(a) an elongate conic rotatable housing having an inner surface therein tapering from one end to define a beach at the tapered end;

(b) a feed tube introduced into said housing for delivering a feed liquid with heavier particles therein;

(c) a flited conveyor in said housing having flites thereon wherein said flites are operatively scrolled to move heavier particles along the housing toward the tapered end;

(d) an internal surface within said housing defining a pond therein to receive the feed liquid so that the pond interacts with the flited conveyor to thereby enable separation by operation of said flited conveyor within said housing;

(e) a stack of closely spaced discs extending into said pond rotating with said housing and having a spacing there between so that liquid from the pond flows between said discs toward the top of said pond, and additionally to permit heavier particles in the liquid to migrate between said discs; and (f) a disc stack conveyor adjacent to said disc stack for conveying heavier particles to said flited conveyor for scrolling there along and to said tapered end.

2. The apparatus of claim 1 wherein said feed tube opens at the end of said tube into a surrounding chamber having nozzles therein and located on an interior of said flited conveyor.

3. The apparatus of claim 1 wherein said tapered housing at the tapered end includes an outlet for the heavier particles separated from the liquid, and said outlet is aligned between a pair of facing plates for directing the heavier particles out of the housing.

4. The apparatus of claim 3 wherein said housing includes a liquid outlet lower in said pond than said feed tube to drain liquid therefrom.

5. The apparatus of claim 1 wherein said flited conveyor comprises an elongate hollow cylindrical shell having flites on the exterior and said flites progressively taper along said conveyor so that said flites fit snugly on an interior defined by said inner surface of said housing.

6. The apparatus of claim 5 wherein said flited conveyor incorporates a single flite thereon having multiple turns extending to the tapered end thereof.

7. The apparatus of claim 1 wherein said tapered housing and said flited conveyor rotate in the same direction and a gear box connected between the said conveyor and said housing imparts rotation from one to the other at a scrolling speed differential.

8. The apparatus of claim 1 wherein said disc stack comprises:

(a) a mounting shaft of specified diameter for said disc stack to receive and support said disc stack thereon;

(b) a radially extending cage surrounding said disc stack to hold said disc stack on said shaft adjacent to the exterior of said disc stack so that heavier particles flow through said disc stack and said cage to the exterior thereof; and (c) a wall of said housing confines said disc stack and said wall surrounds said disc stack and said wall has an opening to said pond to drain liquid from said pond to the exterior of said housing.

9. The apparatus of claim 8 wherein said opening comprises one or more openings at a specified radial location on said housing so that said openings cumulatively drain liquid from said pond.

10. The apparatus of claim 9 wherein said pond extends along the length of said tapered housing, and said disc stack is positioned so that all liquid passing through said opening must pass through said disc stack.

11. The apparatus of claim 9 including a gear box connected between said housing and said conveyor to impart scrolling conveyor rotation.

12. The apparatus of claim 1 wherein said housing comprises a radially directed external flange supporting said housing and said flange connects with said housing at the tapered end and thereby defines a support opening means from said housing for heavier particles.

13. The apparatus of claim 12 wherein said flange joins to the end of said tapered housing at the tapered end, and said flange and tapered end cooperatively are positioned on the interior of a surrounding cover having a pair of spaced housing partitions at right angles to the axis of rotation of said housing so that heavier particles therefrom are centrifically thrown in said cover between said pair of spaced partitions and are confined there between.

14. The apparatus of claim 1 wherein said flited conveyor incorporates an elongate cylindrical centered member on an interior of said flited conveyor, an end located flange thereon, and a gear box connected drive shaft for imparting rotation to said flited conveyor.

15. The apparatus of claim 14 wherein said flange extends radially outwardly at right angles to an axis of rotation of said housing and supports said disc stack conveyor on the outer circumference thereof so that said disc stack conveyor scrolls dry particles there along; and said housing includes a right cylindrical portion surrounding said disc stack.

16. The apparatus of claim 15 wherein said housing terminates at said tapered end and supports at that end said gear box connected drive shaft adapted to be connected with means for rotation of said housing, and the opposite end of said housing operatively connects with a gear box to impart rotation to rotate an output shaft from said gear box for rotation of said flited conveyor.

17. The apparatus of claim 1 wherein said housing incorporates said tapered portion terminating at a larger right cylindrical portion and said right cylindrical portion is sized to fit about said disc stack, with space there between and said disc stack conveyor is located in said space.

18. The apparatus of claim 1 including:

(a) a fixed protective cover over said housing;

(b) a cover supported, downwardly directed liquid outlet to deliver liquid flow after separation;

(c) a cover supported, downwardly directed heavier particle outlet to deliver heavier particles after operation and;

(d) a support to position said housing and said feed tube horizontally beneath said cover so that said outlets are below said cover over said housing.

19. The apparatus of claim 18 wherein said support holds said feed tube horizontally and stationary.

20. The apparatus of claim 1 wherein said tapered housing at the tapered end includes an outlet for the heavier particles separated from the liquid, and said outlet is aligned with deflector plates for directing the heavier particles out of the housing.

21. A high speed centrifuge comprising:

(a) an elongate rotatable housing having an internal surface therein;

(b) a feed tube introduced into said housing for delivering a feed liquid with heavier particles therein;

(c) an internal surface within said housing defining a pond therein to receive the feed liquid;

(d) a stack of closely spaced discs extending into said pond and rotating with said housing and having a spacing there between so that liquid from the pond flows between said discs toward the top of said pond, and additionally to permit heavier particles in the liquid to flow between said discs to the bottom of said pond;

(e) shaped surfaces in said pond positioned cooperatively with respect to said disc stack to quiet liquid feed to prevent pond vortex motion; and (f) a conveyor adjacent to said disc stack for scrolling heavier particles there along and away from said disc stack.

22. The apparatus of claim 21 wherein said feed tube opens at the end of said tube into a surrounding chamber having nozzles therein to flow liquid into said pond and said disc sack.

23. The apparatus of claim 22 wherein said housing includes a liquid outlet lower in said pond than said feed tube to drain liquid therefrom and the flow of liquid from said tube to said outlet is through said disc stack.

24. The apparatus of claim 21 wherein said housing and said disc stack rotate in the same direction and a gear box connected to said housing imparts scrolling speed differential to said conveyor.

25. The apparatus of claim 21 wherein said disc stack comprises:

(a) a mounting shaft of specified diameter for said disc stack to receive and support said disc stack thereon;

(b) a radially extending cage surrounding said disc stack to hold said disc stack on said shaft adjacent to the exterior of said disc stack so that heavier particles flow through said disc stack and said cage to the exterior thereof; and (c) a wall of said housing surrounds said disc stack and has an opening to said pond to drain liquid from said pond to the exterior of said housing.

26. The apparatus of claim 25 wherein said opening comprises one or more openings at a specified radial location on said housing so that said openings cumulatively drain liquid from said pond.

27. The apparatus of claim 25 wherein said disc stack is positioned so that all liquid passing through said opening must pass through said disc stack.

28. The apparatus of claim 21 wherein:

(a) said feed tube has an opening at a fixed elevation with respect to said pond;

(b) said disk stack extends from above said pond into said pond for a specified depth;

(c) said disc stack spans the width of said pond; and (d) an opening in said housing drains said pond wherein said pond drain opening defines the maximum pond depth.

29. The apparatus of claim 28 wherein said disc stack intercepts all liquid introduced by said feed tube.

30. The apparatus of claim 29 wherein said disc stack spacing is about 0.2 inches enable faster settling of said heavier particles.

31. A high speed centrifuge comprising:

(a) an elongate rotatable housing;

(b) a feed tube for delivering a feed liquid with heavier particles therein into said housing;

(c) an internal surface within said housing defining a pond therein to receive the feed liquid for the pond;

(d) a stack of closely spaced discs attached to said housing and extending into said pond and having a spacing there between so that liquid from the pond flows between said discs toward the top of said pond, and heavier particles in the liquid migrate between said discs to emerge on the exterior of said disc stack;

(e) means adjacent to said disc stack for conveying heavier particles therefrom; and (f) a housing drain opening below the level of said pond wherein said drain and feed tube are located so that liquid flowing toward said drain flows through said disc stack.

32. The apparatus of claim 31 wherein said feed tube opens at the end of said tube into a feed receiving chamber located on an interior of a flited conveyor in said housing.

33. The apparatus of claim 31 including an elongate flited conveyor having an elongate hollow cylindrical shell having flites on the exterior and said flites progressively taper along said conveyor so that said flites fit snugly on an interior of said housing.

34. The apparatus of claim 33 wherein said flited conveyor incorporates a single flite thereon having multiple turns extending to the tapered end thereof.

35. The apparatus of claim 33 wherein said tapered housing and said flited conveyor rotate in the same direction and a gear box connected between the said conveyor and said housing imparts rotation from one to the other at a scrolling speed differential.

36. The apparatus of claim 31 wherein said disc stack comprises:

(a) a mounting shaft of specified diameter for said disc stack to receive and support said disc stack thereon;

(b) a radially extending cage surrounding said disc stack to hold said disc stack on said shaft adjacent to the exterior of said disc stack so that heavier particles flow through said disc stack and said cage to the exterior thereof; and (c) a wall of said housing confines said disc stack and said wall surrounds said disc stack and said wall has an opening to said pond to drain liquid from said pond to the exterior of said housing.

37. The apparatus of claim 36 wherein said opening comprises one or more openings at a specified radial location on said housing so that said openings cumulatively drain liquid from said pond.

38. The apparatus of claim 37 wherein said pond extends along the length of said tapered housing, and said disc stack is positioned so that all liquid passing through said opening must pass through said disc stack.

39. The apparatus of claim 31 wherein said housing comprises a radially directed external flange supporting said housing and said flange connects with said housing at the tapered end and thereby defines a support opening means from said housing for heavier particles.

40. The apparatus of claim 39 wherein said flange joins to the end of said tapered housing at the tapered end, and said flange and tapered end cooperatively are positioned on the interior of a surrounding cover having a pair of spaced housing partitions at right angles to the axis of rotation of said housing so that heavier particles therefrom are centrifically thrown in said cover between said pair of spaced partitions and are confined there between.

41. The apparatus of claim 31 including a flited conveyor having an elongate cylindrical centered member interiorally of said flited conveyor, an end located flange thereon, and a gear box connected drive shaft for imparting rotation to said flited conveyor.

42. The apparatus of claim 41 wherein said flange extends radially outwardly at right angles to an axis of rotation of said housing and supports said conveyor on the outer circumference thereof so that said conveyor scrolls dry particles there along; and said housing includes a right cylindrical portion surrounding said convevor.

43. The apparatus of claim 42 wherein said housing terminates at said tapered end and supports at that end said gear box connected drive shaft adapted to be connected with means for rotation of said housing, and the opposite end of said housing operatively connects with a gear box to impart rotation to rotate an output shaft from said gear box for rotation of said flited conveyor.

44. The apparatus of claim 31 including:

(a) a fixed protective cover over said housing;

(b) a cover supported, downwardly directed liquid outlet to deliver liquid flow after separation;

(c) a cover supported, downwardly directed heavier particle outlet to deliver heavier particles after operation;

(d) a support to position said housing and said feed tube horizontally beneath said cover so that said outlets are below said cover over said housing; and (e) wherein said support holds said feed tube horizontally and stationary.

* * * * *